United States Patent [19]

Wang et al.

[11] 4,233,150

[45] Nov. 11, 1980

[54] PROCESS FOR BENEFICIATION OF NON-SULFIDE IRON-FREE ORES

[75] Inventors: Samuel S. Wang, Cheshire; Eugene L. Smith, Jr., Milford, both of Conn.

[73] Assignee: American Cyanamid Company, Stamford, Conn.

[21] Appl. No.: 4,643

[22] Filed: Jan. 19, 1979

Related U.S. Application Data

[63] Continuation-in-part of Ser. No. 819,302, Jul. 27, 1977, abandoned, Ser. No. 723,840, Sep. 16, 1976, abandoned, Ser. No. 686,629, May 14, 1976, abandoned, and Ser. No. 650,094, Jan. 19, 1976, abandoned.

[51] Int. Cl.[3] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,099,120 | 11/1937 | Kirby | 209/166 |
| 2,120,217 | 6/1938 | Harris | 209/166 |
| 3,779,380 | 12/1973 | Bishop | 209/166 |
| 3,859,207 | 1/1975 | Knocke | 209/166 |
| 4,081,363 | 3/1978 | Grayson | 209/166 |
| 4,148,720 | 4/1979 | Wang | 209/166 |

*Primary Examiner*—Robert Halper

*Attorney, Agent, or Firm*—Paul W. Leuzzi, II

[57] ABSTRACT

Improved beneficiation of non-sulfide iron free ores by froth flotation results when the collector employed is a mixture of a naturally derived fatty acid and a partial ester of a polycarboxylic acid having at least one free carboxylic acid group.

8 Claims, No Drawings

PROCESS FOR BENEFICIATION OF NON-SULFIDE IRON-FREE ORES

CROSS REFERENCE TO RELATED APPLICATIONS

This application is a continuation-in-part of application Ser. Nos. 819,302, filed July 27, 1977 now abandoned; 723,840, filed Sept. 16, 1976 now abandoned; 686,629, filed May 14, 1976 now abandoned; and 650,094, filed Jan. 19, 1976 now abandoned.

This invention relates to a process for the beneficiation of non-sulfide ores. More particularly, this invention relates to such a process wherein combinations of common naturally derived fatty acids of vegetable or animal oil sources and half esters of linear alcohols as froth flotation agents provide beneficial effects.

Froth flotation is the principal means by which phosphate, barite, fluorite, prematite, taconic, magnetite, cement rock, and a host of other ores are concentrated. Its chief advantage lies in the fact that it is a relatively efficient process operating at substantially lower costs than many other processes.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends upon the relative wettability of surfaces. Typically, the surface-free energy is purportedly lowered by the adsorption of heteropolar surface-active agents. The hydrophobic coating thus provided acts in this explanation as a bridge so that the particle may be attached to an air bubble. The practice of this invention is not limited by this or other theories of flotation.

In processing non-sulfide ores, the ore is sized for flotation, is conditioned with fatty acid and additives such as pH adjustors, frothers, and the like, and is froth floated by conventional froth flotation routes. Depending upon the non-sulfide ore treated, not all gangue material may be removed in the first, or rougher, flotation and, when necessary, a second, or cleaner, flotation is run, also employing conventional procedures.

Although the procedure described above is effective in recovery of non-sulfide ores from their gangue materials, there, nevertheless, exists the need for more effective processes which will provide increased recovery of mineral values while still providing high grade recovery. In view of the large quantities of non-sulfide ores processed by froth flotation, such a development can result in a substantial increase in the total amount of mineral values recovered and provide substantial economical advantages even when a modest increase in recovery is provided. It is also desirable to have an efficient collector system for use at reduced dosage levels without sacrificing the mineral recovery performance. Decreases in reagent consumption are significant in view of the increasing diversion of naturally derived fatty acids for nutritional and other purposes. The advantages of having a collector system which achieves savings in usage of petroleum based fuel oil for optimum mineral recovery are readily apparent to an energy intensive society. Accordingly, the provision for an improved process for froth flotation of non-sulfide minerals would fulfill a long-felt need and constitute a notable advance in the art.

In accordance with the present invention, there is provided a process for the beneficiation of non-sulfide ores which comprises classifying the ore to provide particles of flotation size, slurrying the sized ore in aqueous medium, conditioning the slurry with an effective amount of a combination of from about 99 to about 5 weight percent of a fatty acid derived from a vegetable or animal oil and, correspondingly, from about 1 to about 95 weight percent of a partial ester of a polycarboxylic acid having at least one free carboxylic acid group, and floating the desired ore values by froth flotation, said partial ester having the structure:

$$R'-O-(CH_2CH_2O)_n-\overset{O}{\overset{\|}{C}}-R-\overset{O}{\overset{\|}{C}}-OH$$

wherein R' is a primary or secondary alkyl group of about 8 to 18 carbon atoms, n is an integer of about 1-10 and R is a bivalent grouping selected from $(CH_2)_m$ wherein m is an integer of 1 to 6, —CH=CH—, —CHOH—CHOH—,

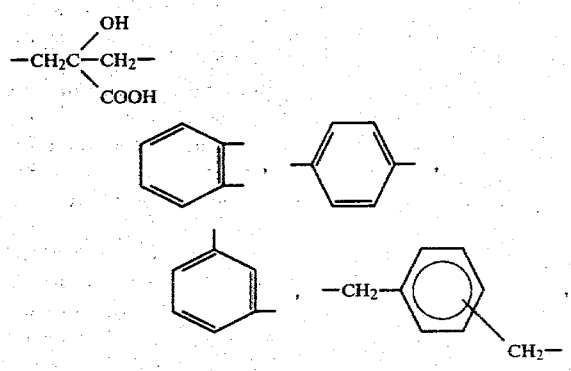

ortho, para, and meta, and $-C_6H_{10}-$.

The combination of fatty acid and partial ester enables the requirements for scarce fatty acids to be reduced while providing high recovery and grade. In most instances, the combination provides superior performance over that obtainable with either component alone. In many instances, the combination reduces dosage requirements for collector for the same recovery and grade of mineral values. In all cases, the requirements for scarce fatty acid can be significantly reduced, while, generally, providing a boost in the recovery obtained. In certain instances, the partial ester alone cannot be effectively employed because of excessive foaming associated with such use. Attempts to abate the foaming by special additives adversely affects recovery and unnecessarily increases costs. However, combinations as used in the present inventions do not cause excessive foaming and provide an increase in recovery over that obtained with the fatty acid alone.

The partial esters used in the present invention are provided by synthesis utilizing specific polycarboxylic acids as esterifying agents. The alcohols and alcohol ethoxylates may be derived from a single component or admixture of two or more alcohols. These synthetic partial esters are moderate in cost and are more readily available than currently used reagents. The synthetic acid can be produced in more consistent, predictable purity and quality than naturally derived scarce products.

In carrying out the process of the present invention, a non-sulfide mineral is selected for treatment. Such minerals include phosphate, fluorite, barite, hematite, taconite, magnetite, cement rock, and the like that are conventionally processed by froth flotation. The selected mineral is screened to provide particles of flotation size according to the conventional procedures. Generally, the flotation size will encompass from about 30×150 mesh size.

After the selected mineral has been sized as indicated, it is slurried in aqueous medium and conditioned with the combination of fatty acid and partial ester as well as such other additives as may be conventionally employed with the selected mineral. Such additives may include alkali or other pH adjustors, frother, fuel oil, foam control agents, and the like as are well known to the skilled artisan. Depending upon the particular mineral to be processed, the content of mineral solids in the slurry will vary according to conventional processing. Generally, the combination of fatty acid and partial ester is used in an amount to provide a level of about 0.1 to 2.0 lbs. of the combination per ton of mineral, although variations in amounts will vary with the specific mineral being processed within conventional ranges.

In carrying out the process of the present invention, a combination of a fatty acid and a partial ester are used in admixture in froth flotation to enable a reduction in the requirements for scarce fatty acids to be achieved while maintaining high recovery and grade or improvements therein.

The fatty acid used in the combination is one derived from a vegetable or animal oil. Vegetable oils include babassu, castor, chinese tallow, coconut, cottonseed, grapeseed, hempseed, kapok, linseed, wild mustard, oiticica, olive, ouri-ouri, palm, palmkernel, peanut, perilla, poppyseed, Argentine rapeseed, rubberseed, safflower, seasame, soybean, sugarcane, sunflower, tall, teaseed, tung and ucuhuba oils. Animal oils include fish and live stock. These oils contain acids ranging from six carbons to twentyeight carbons or more which may be saturated or unsaturated, hydroxylated or not, linear or cyclic, and the like.

The partial ester used in the combination is derived from a polycarboxylic acid in which at least one free carboxylic acid group is present and which partial ester has a structure given by

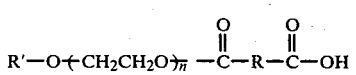

wherein R′ is a primary or secondary alkyl group of about 8 to 18 carbon atoms, n is an integer of 1-10 and R is a bivalent grouping selected from $-(CH_2)_m-$, wherein m is an integer of 1-6; —C=CH—;

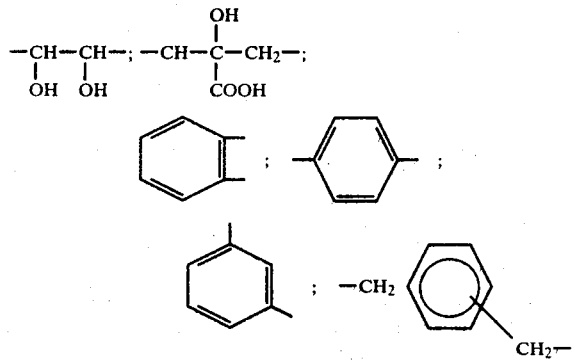

(ortho, meta, and para), $-C_6H_8-$ and $-C_6H_{10}-$.

Typically, the useful partial esters are reaction products of an alcohol or alcohol ethoxylate of the general structure $R'-O-(CH_2CH_2O)_n$ wherein R′ is a primary or secondary alkyl group of 8 to 18 carbon atoms and n is as defined above and di- or tribasic acids such as maleic, citric, tartaric, succinic, adipic, phthalic, cyclohexyl dicarboxylic, cyclohexenyl dicarboxylic terephthalic, and similar acids. The alcohol or alcohol ethoxylates may be derived from a single component or admixture of two or more alcohols. Preferably the polycarboxylic acid used in forming the partial ester is maleic acid. Preferably an alcohol ethoxylate is used such that the alkyl group contains 11 to 15 carbon atoms and n is 2 to 3. Suitable partial esters include those of the following structures:

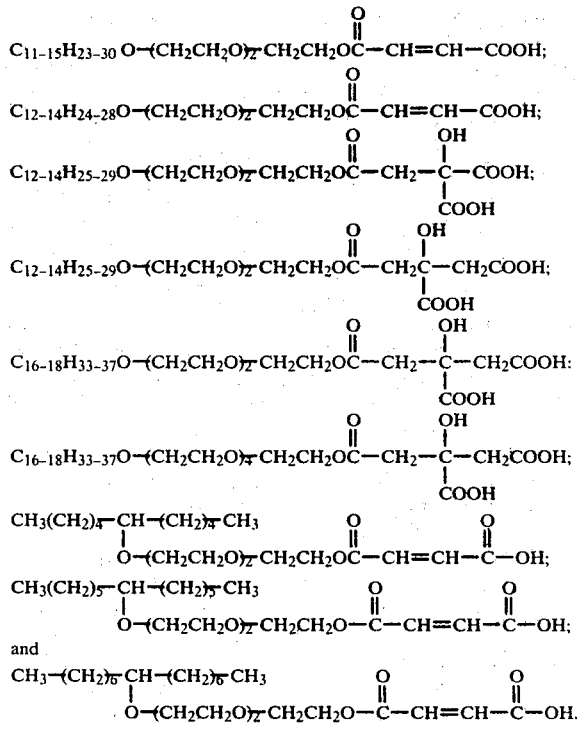

The acid and partial ester are used in the combination such that the fatty acid will constitute from about 99 to about 5 weight percent and, correspondingly, the partial ester will constitute from about 1 to about 95 weight percent of the combination. The combination providing maximum recovery will vary depending upon the specific nonsulfide ore processed and will vary among different samples of the same ores.

The principles of the present invention apply to nonsulfide ores that are processable by froth flotation in general. Typical ores are those illustrated by fluorite or fluorspar, barite or barytes, hematite, taconite, or hematite, phosphate rock of the pebble rock of the pebble type as found in Forida or foskorite as found in South Africa. Other non-sulfide minerals that are processed by froth flotation using an acid collector may also be processed.

The invention is more fully illustrated by the examples which follow, wherein all parts and percentages are by weight unless otherwise specified. Three specific general procedures for froth flotation of specified ores are described below and are followed in the examples which follow.

GENERAL PROCEDURE—PHOSPHATE ROCK

Rougher Float

Step 1

Secure washed and sized feed, e.g., 35×150 mesh screen fractions. Typical feed is usually a mixture of 23% coarse with 77% fine flotation particles.

Step 2

Sufficient wet sample, usually 640 grams, to give a dry weight equivalent of 500 grams. The sample is washed once with about an equal amount of tap water. The water is carefully decanted to avoid loss of solids.

Step 3

The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct end point. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4

Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5

The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

GENERAL PROCEDURE—BARITE

Step 1

Charge the wet barite flotation feed, 2350 grams (37.5% solids) into a 2-liter beaker. Start agitation. Feed is maintained at 90° F. and pH of 7.9.

Step 2

Add the collector and 0.067 pound of methylisobutyl carbinol (MIBC) per ton of ore. Condition for one minute.

Step 3

Transfer the conditioned feed slurry into a laboratory model D-1 Denver flotation cell. Dilute with water to 30% solids.

Step 4

Open air inlet and begin flotation for four minutes at 1200 RPM.

Step 5

Shut off air flow. Add collector and 0.022 lb/ton of MIBC. Condition for ½ minute.

Step 6

Continue the flotation for two minutes adding water throughout test to maintain pulp level.

Step 7

Dry the combined rougher concentrates and the tailings separately. Calculate percent of recovery based on weight of recovered concentrate and assay results of the concentrate and the tailing.

GENERAL PROCEDURE—FLUORSPAR

Step 1

Grind a 1,000 gram of a −10 mesh ore sample in a laboratory rod mill for 11 minutes at 60% solids to produce a size distribution of 20%+100 mesh and 69%−200 mesh size distribution.

Step 2

Transfer the ground ore feed into a Denver D-1 flotation cell. Dilute to 33% solids with water.

Step 3

Add 1.0 lb. of $Na_2CO_3$, 0.6 lb. of Quebracho, and 0.6 lb. of $Na_2SiO_3$ per ton of ore to the slurry. Start agitation at 1300 rpm and condition for 4½ minutes.

Step 4

Add the collector and 0.054 lb. of frother per ton of ore. Continue the agitation for 4½ minutes.

Step 5

Introduce air and float for 2 minutes.

Step 6

Turn off air. Add collector and 0.018 lb. of frother per ton of ore. Condition for 15 seconds.

Step 7

Turn on air and float for 2 minutes.

Step 8

Repeat Step 6.

Step 9

Repeat Step 7 but float for 1½ minutes.

Step 10

Dry the combined rougher concentrates and the tailing. Calculate percent of recovery based on weight of rougher concentrates and $CaF_2$ assay results of the concentrate and the tailing.

COMPARATIVE EXAMPLE A

Using as collector a tall oil fatty acid composition, a sample of Florida phosphate rock was processed according to the General Procedure described above. The tall oil composition contained 4.2% rosin acids, 1.6% unsaponifiables, and 94.2% of fatty acids. The fatty acids had the following composition:

| | |
|---|---|
| Polyunsaturated, Conjugated as linoleic % | 8 |
| Polyunsaturated, Nonconjugated as linoleic % | 32 |
| Oleic % | 44 |
| Saturated % | 5 |
| Other % | 11 |
| | 100 |

Results obtained are shown in Table I.

COMPARATIVE EXAMPLE B

Using the phosphate rock of Comparative Example A and the General Procedure, a partial ester of maleic acid of the following composition was employed as collector:

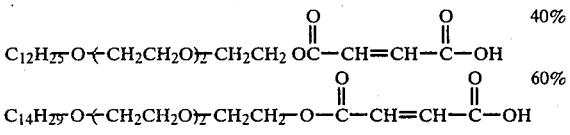

Results are also shown in Table I.

EXAMPLES 1-3

Again using the phosphate rock of comparative Example A and the General Procedure, a series of runs were made in which mixtures of the collectors of Comparative Examples A and B were employed as collectors. Details and results are given in Table I.

TABLE I

| | PHOSPHATE RECOVERY, FLORIDA PHOSPHATE ROCK | | | | | | |
|---|---|---|---|---|---|---|---|
| | COLLECTOR USED | | CONCENTRATE | GRADE, % BPL | | | RECOVERY |
| Example | A[1], lbs/ton | B[2], lbs./ton | Weight % | Feed | Tail | Conc. | % BPL |
| Comparative A-1 | 1.0 | — | 18.90 | 16.27 | 6.16 | 59.65 | 69.29 |
| Comparative A-2 | 1.3 | — | 21.28 | 16.47 | 3.54 | 64.30 | 83.08 |
| Comparative B | — | 1.0 | 25.14 | 16.45 | 2.67 | 57.47 | 87.85 |
| 1 | 0.9 | 0.1 | 24.23 | 16.61 | 2.05 | 62.21 | 90.66 |
| 2 | 0.8 | 0.2 | 25.81 | 16.56 | 1.62 | 59.52 | 92.74 |
| 3 | 0.7 | 0.3 | 28.16 | 16.86 | 1.79 | 55.30 | 92.38 |

[1]Collector A = Fatty acid of Comparative Example A
[2]Collector B = Partial ester of Comparative Example B
Note:
The Collector to Fuel Oil weight ratio is 1:1 in all above cases.

The results given in Table I show that the combination of fatty acid and partial ester, as taught by the present invention, provides higher recovery of BPL than can be obtained with the individual components alone while still maintaining high grade concentrate.

COMPARATIVE EXAMPLE C

Using the phosphate rock of Comparative Example A and the General Procedure, a distillation tall oil fatty acid composition of the following composition was employed:

| | Heads 50% | Bottom 50% |
|---|---|---|
| Rosin Acids | 0.6% | 15-25 |
| Unsaponifiables | 25.0% | 30-36 |
| Fatty Acids | 74.4% | 34-58 |

The fatty acid content is of the ingredients as in the composition of Comparative Example A except that different proportions are present. Results are given in Table II.

COMPARATIVE EXAMPLE D

Again using the phosphate rock of Comparative Example A and the General Procedure, a partial ester of maleic acid of the following composition was used as collector:

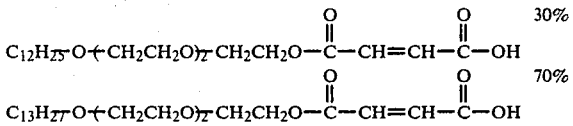

Results are shown in Table II.

EXAMPLES 4-6

Again using the phosphate rock of Comparative Example A and the General Procedure, a series of runs were made in which mixtures of the collectors of Comparative Examples C and D were employed as collectors. Details and results are given in Table II.

TABLE II

| | PHOSPHATE RECOVERY, FLORIDA PHOSPHATE ROCK | | | | | | |
|---|---|---|---|---|---|---|---|
| | COLLECTOR USED | | CONCENTRATE | GRADE, % BPL | | | RECOVERY |
| Example | C[1], lb./ton | D[2], lb./ton | Weight% | Feed | Tail | Conc. | % BPL |
| C-1 | 1.0 | — | 14.65 | 16.07 | 8.06 | 62.75 | 57.21 |
| C-2 | 1.5 | — | 23.93 | 16.50 | 2.62 | 60.63 | 87.92 |
| D | — | 1.0 | 24.64 | 16.49 | 4.24 | 53.95 | 80.61 |
| 4 | 0.9 | 0.1 | 24.70 | 16.40 | 1.64 | 61.42 | 92.48 |
| 5 | 0.8 | 0.2 | 26.22 | 16.58 | 1.49 | 59.02 | 93.37 |
| 6 | 0.7 | 0.3 | 27.62 | 15.92 | 1.31 | 54.19 | 94.05 |

[1]Collector C = Fatty Acid of Comparative Example C
[2]Collector D = Partial ester of Comparative Example D
Note:
The Collector to Fuel Oil weight ratio is 1:1 in all above cases.

The results given in Table II again show that the combination of fatty acid and partial ester, as taught by the present invention, provides higher recovery of BPL than can be obtained with the individual components alone while still maintaining high grade concentrate.

COMPARATIVE EXAMPLE E

The procedure of Comparative Example C was followed except that a different sample of Florida phosphate rock was employed. Results are given in Table III.

COMPARATIVE EXAMPLE F

The procedure of Comparative Example B was followed except that the phosphate rock of Comparative Example E was employed. Results are given in Table III.

EXAMPLE 7

Again using the phosphate rock of Comparative Example E and the General Procedure, a run was made in which a 90:10 mixture of the collectors of Comparative Examples E and F was employed. Results are given in Table III.

TABLE III

| | PHOSPHATE RECOVERY, FLORIDA PHOSPHATE ROCK | | | | | | |
|---|---|---|---|---|---|---|---|
| | COLLECTOR USED | | CONCENTRATE | GRADE, % BPL | | | RECOVERY |
| Example | C, lb./ton | B, lb./ton | Weight % | Feed | Tail | Conc. | % BPL |
| E-1 | 1.0 | — | 22.04 | 17.40 | 4.26 | 63.91 | 80.92 |
| E-2 | 1.3 | — | 26.11 | 17.34 | 1.97 | 60.83 | 91.60 |
| E-3 | 1.50 | — | 26.19 | 16.72 | 1.64 | 59.21 | 92.75 |
| F | — | 1.0 | 25.90 | 16.68 | 3.06 | 55.65 | 86.41 |
| 7 | 0.9 | 0.1 | 23.84 | 17.12 | 1.57 | 63.63 | 92.69 |

Note:
The Collector to Fuel Oil Weight ratio is 1:1 in all above cases.

The results given in Table III again show the higher recovery values shown by combinations of the present invention. A dosage of one pound per ton of ores of the 90/10 mixture, in fact, performs better than the conventional fatty acids alone at 1.3 lb./ton.

COMPARATIVE EXAMPLE G

Again using the phosphate rock of Comparative Example A and the General Procedure, a run was made using a standard mixture of tall oil fatty acids designated G. Details and results are given in Table IV.

COMPARATIVE EXAMPLE H

The procedure of Comparative Example G was followed except that a different standard mixture of tall oil fatty acids designated H was used. Details and results are given in Table IV.

COMPARATIVE EXAMPLE I

The procedure of Comparative Example G was again followed except in place of the tall oil fatty acid mixture there was used a partial ester (I) of the structure:

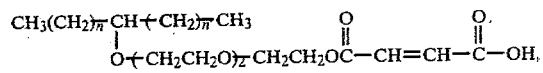

wherein $n+n'=8$ to 12 (a mixture). Details and results are given in Table IV.

EXAMPLE 8

The procedure of Comparative Example G was again followed except that a mixture of tall oil fatty acids G and the partial ester of Comparative Example I were used at a ratio of 95/5, respectively. Details and results are given in Table IV.

EXAMPLE 9

The procedure of Comparative Example G was again followed except that a mixture of tall oil fatty acids H and the partial ester of Comparative Example I were used in a 95/5 ratio, respectively. Details and results are given in Table IV.

TABLE IV

| | | Phosphate Recovery, Florida Phosphate Rock | | | | | | |
|---|---|---|---|---|---|---|---|---|
| | | | No. 5 Fuel Oil | % Wt. | % BPL | | | % BPL |
| Example | Collector | Used lb./ton | lb./ton | Recovery | Feed | Tail | Conc. | Recovery |
| Comparative G | Tall Oil G | 1.0 | 1.0 | 19.61 | 20.25 | 7.98 | 70.55 | 68.32 |
| 8 | 95/5 Tall Oil G/Partial Ester I | 1.0 | 1.0 | 27.61 | 21.27 | 3.47 | 67.95 | 88.19 |
| Comparative H | Tall Oil H | 1.0 | 1.0 | 24.86 | 19.53 | 3.17 | 69.00 | 87.80 |
| 9 | 95/5 Tall Oil H/Partial Ester I | 1.0 | 1.0 | 28.87 | 20.84 | 1.97 | 67.32 | 93.28 |
| Comparative I | Partial Ester I | 1.0 | 1.0 | 21.19 | 19.45 | 7.60 | 63.54 | 69.22 |

The results given in Table IV again show the higher results achieved by the present invention and that secondary alcohol ether ethoxylate partial esters are effective in the collection combination.

COMPARATIVE EXAMPLE I

Following the General Procedure described with respect to barite flotation, a reconstituted all oil fatty acid was evaluated with a barite ore. Dosages and results are given in Table V.

EXAMPLE 10

Again following the General Procedure described with respect to barite flotation, a mixture of 95 parts of the reconstituted tall oil fatty acid used in Comparative Example J and 5 parts of the partial ester of Comparative Example D. Dosages and results are given in Table V.

TABLE V

| Example | Collector | BARITE RECOVERY DOSAGE LB./TON 1st Add | 2nd Add | TOTAL | RECOVERY Wt. (%) | $BaSO_4$ (%) Feed | Tail | Conc. | RECOVERY $BaSO_4$ (%) |
|---|---|---|---|---|---|---|---|---|---|
| Comparative J | Reconstituted Tall Oil | 0.138 | 0.069 | 0.207 | 40.12 | 23.97 | 9.04 | 46.26 | 77.42 |
| 10 | 95 Reconstituted Tall Oil<br>5 Partial Ester D | 0.116 | 0.078 | 0.194 | 43.55 | 24.05 | 7.72 | 45.21 | 81.88 |

The results given in Table V show that the collector combination provides higher barite recovery at higher grade than does the reconstituted tall oil fatty acid conventionally employed. Use of the partial ester alone with this feed was not practical because the excessive foaming produced cannot be handled on commercial equipment. Use of an effective defoamer with the partial ester alone resulted in poor barite recovery.

COMPARATIVE EXAMPLE K

Following the General Procedure described for fluorspar, tall oil fatty acid was evaluated using a fluorite ore. Dosages and results are given in Table VI.

EXAMPLE 11

Following the General Procedure described for fluorspar, a combination of 95 parts of tall oil fatty acid used in Comparative Example K and 5 parts of the partial ester used in Comparative Example D was evaluated using a fluorite ore. Dosages and results are given in Table VI.

TABLE VI

| Example | | FLUORITE RECOVERY DOSAGE LB./TON 1st Add | 2nd Add | 3rd Add | TOTAL | RECOVERY Wt. (%) | $CaF_2$ (%) Feed | Tail | Conc. | RECOVERY $CaF_2$ (%) |
|---|---|---|---|---|---|---|---|---|---|---|
| Comparative K | Tall Oil Fatty Acid | 0.28 | 0.20 | 0.12 | 0.60 | 66.72 | 65.94 | 10.3 | 93.7 | 94.80 |
| " | | 0.20 | 0.12 | 0.08 | 0.40 | 59.42 | 66.15 | 22.0 | 96.3 | 86.50 |
| " | | 0.12 | 0.04 | 0.04 | 0.20 | 44.59 | 66.56 | 42.0 | 97.2 | 64.97 |
| 11 | 95 Tall Oil Fatty Acid<br>5 Partial Ester D | 0.28 | 0.20 | 0.12 | 0.60 | 73.36 | 66.67 | 6.28 | 88.6 | 97.49 |
| " | | 0.20 | 0.12 | 0.08 | 0.40 | 69.70 | 63.14 | 3.88 | 88.9 | 98.14 |
| " | | 0.12 | 0.04 | 0.04 | 0.20 | 51.66 | 63.61 | 30.5 | 94.6 | 76.82 |

NOTES:
1. 0.44 Lb/Ton Fuel Oil in each run
2. 0.55 Lb/Ton NaOH in each run
3. 0.165 Lb/Ton Frother in each run except Example 18

The results given in Table VI show the beneficial results obtained when a combination of fatty acid and partial ester is employed compared to the use of fatty acid alone. Again, the partial ester alone caused too excessive amounts of foam to be useful in commercial equipment.

COMPARATIVE EXAMPLE L

Using the General Procedure for Phospate Rock, oleic acid derived from safflower seed was employed as collector using polypropylene glycol, MW 425, as frother in froth floating cement rock. Dosages and results are given in Table VII.

EXAMPLES 12–16

The procedure of Comparative Example L combinations of the oleic acid of Comparative Example L and the partial ester of Comparative Example D were employed as collectors for cement rock. Compositions, dosages, and results are given in Table VII.

TABLE VII

CEMENT ROCK FLOTATION

| Example | Collector | Lb./Ton | $CaCO_3$ Wt. (%) Feed | Conc. | $CaCO_3$ (%) Recovery |
|---|---|---|---|---|---|
| Comparative L | Oleic Acid | 1.65 | 53.10 | 87.0 | 45.3 |
| 12 | 80 Oleic Acid<br>20 Partial Ester D | 1.65 | 53.10 | 85.5 | 48.2 |
| 13 | 60 Oleic Acid<br>40 Partial Ester D | 1.65 | 53.10 | 80.4 | 76.7 |
| 14 | 50 Oleic Acid<br>50 Partial Ester D | 1.65 | 51.0 | 83.0 | 79.3 |
| 15 | 40 Oleic Acid<br>60 Partial Ester D | 1.65 | 53.10 | 77.2 | 80.0 |
| 16 | 20 Oleic Acid<br>80 Partial Ester D | 1.65 | 51.0 | 83.7 | 74.1 |

The results given in Table VIII show that combinations of the collectors used in the present invention improve recovery compared to that obtained with the fatty acid alone. Use of the partial ester alone caused excessive foaming and could not be run on commercial equipment.

COMPARATIVE EXAMPLE M

Using the General Procedure for Phosphate Rock, reconstituted tall oil fatty acid was employed with an equal weight of 20.5 fuel oil for flotation of Florida phosphate rock. Dosages and results are given in Table VIII.

EXAMPLES 17–26

The procedure of Comparative Example M was followed except that the collector used was a combination of reconstituted tall oil fatty acid and the partial ester of Comparative Example D. Compositions, dosages, and results are also given in Table VIII.

COMPARATIVE EXAMPLE N

The procedure of Comparative Example M was again followed except that the collector was the partial ester of Comparative Example D. Dosages and results are given in Table VIII.

TABLE VIII

| Example | Collector | BPL RECOVERY RECOVERY Wt. (%) | BPL (%) Feed | BPL (%) Tail | BPL (%) Conc. | BPL (%) RECOVERY |
|---|---|---|---|---|---|---|
| Comparative M | Recon. Tall Oil Fatty Acid | 25.07 | 22.15 | 6.80 | 68.02 | 77.00 |
| 17 | 95 Recon Tall Oil FA 5 Partial Ester D | 31.07 | 22.37 | 3.10 | 65.11 | 90.44 |
| 18 | 90 Recon Tall Oil FA 10 Partial Ester D | 31.32 | 22.09 | 2.90 | 63.22 | 91.05 |
| 19 | 80 Recon Tall Oil FA 20 Partial Ester D | 32.93 | 21.73 | 1.97 | 61.97 | 93.92 |
| 20 | 70 Recon Tall Oil FA 30 Partial Ester D | 32.32 | 22.03 | 2.56 | 62.81 | 92.13 |
| 21 | 60 Recon Tall Oil FA 40 Partial Ester D | 31.06 | 22.01 | 3.61 | 62.86 | 88.69 |
| 22 | 50 Recon Tall Oil FA 50 Partial Ester D | 32.09 | 22.11 | 2.61 | 63.38 | 91.99 |
| 23 | 40 Recon Tall Oil FA 60 Partial Ester D | 31.45 | 22.13 | 4.98 | 59.52 | 84.57 |
| 24 | 30 Recon Tall Oil FA 70 Partial Ester D | 30.10 | 22.38 | 5.68 | 61.16 | 82.26 |
| 25 | 20 Recon Tall Oil FA 80 Partial Ester D | 28.44 | 21.73 | 6.29 | 60.52 | 79.29 |
| 26 | 10 Recon Tall Oil FA 90 Partial Ester D | 11.55 | 22.53 | 17.06 | 64.46 | 33.03 |
| N | Partial Ester D | 9.0 | 22.61 | 19.38 | 55.32 | 22.02 |

Notes:
1. 0.5 LB./TON Collector used in each run
2. 0.5 No. 5 Fuel Oil used in each run
3. pH 9.0–9.2.

The results given in Table VIII show the improved results obtained using the combinations of the present invention.

COMPARATIVE EXAMPLE O

The procedure of Comparative Example M was again followed except that the usage of No. 5 fuel oil was varied. Dosages and results are given in Table IX.

EXAMPLES 27–29

The procedure of Example 18 was followed except that the usage of No. 5 fuel oil was varied. Dosages and results are also given in Table IX.

TABLE IX

| Example | FUEL OIL Lb./Ton | BPL RECOVERY RECOVERY Wt. (%) | RECOVERY Feed | RECOVERY Tail | RECOVERY Conc. | RECOVERY BPL (%) |
|---|---|---|---|---|---|---|
| Comparative O | — | 23.67 | 22.97 | 8.58 | 69.36 | 71.48 |
| " | 0.25 | 21.19 | 21.88 | 9.48 | 68.00 | 65.86 |
| " | 0.50 | 25.07 | 22.65 | 6.80 | 68.02 | 77.00 |
| 27 | — | 26.26 | 21.92 | 5.99 | 66.64 | 79.85 |
| 28 | 0.25 | 26.44 | 22.54 | 6.56 | 67.00 | 78.59 |
| 29 | 0.50 | 31.32 | 22.09 | 2.90 | 63.22 | 91.05 |

Notes:
1. Comparative O run with 0.5 Lb./Ton Recon Tall Oil Fatty Acid
2. Ex. 27–29 run with combination of 90 parts Recon Tall Oil Fatty Acid and 10 parts Partial Ester D at 0.5 Lb./Ton.

EXAMPLE 30

Following the general procedure of Comparative Example A, a partial ester involving citric acid is employed in combination with a crude tall oil fatty acid. Results are as follows:

| Ex. | Collector | Usage lbs/ton | Fuel Oil No. 5 lbs/ton | Weight Recovery % | BPL (%) Feed | BPL (%) Tail | BPL (%) Conc. | BPL Recovery % |
|---|---|---|---|---|---|---|---|---|
| Control | Tall Oil Fatty Acid | 0.5 | 0.5 | 8.14 | 16.55 | 12.10 | 66.76 | 32.84 |
| 30 | 90/10 TOFA[1] Citric Acid Partial | | | | | | | |

-continued

| Ex. | Collector | Usage lbs/ton | Fuel Oil No. 5 lbs/ton | Weight Recovery % | BPL (%) Feed | BPL (%) Tail | BPL (%) Conc. | BPL Recovery % |
|---|---|---|---|---|---|---|---|---|
| | Ester[2] | 0.5 | 0.5 | 1 17.25 | 9.13 | 71.65 | 53.95 | |

Notes:
[1]TOFA = Tall Oil Fatty Acid
[2]Citric Acid Partial =

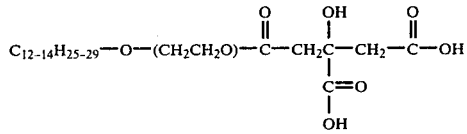

EXAMPLE 31

The procedure of Example 30 was followed using a reconstituted tall oil fatty acid in combination with a partial ester of phthalic acid. The results are as follows:

| Ex. | Collector | Usage lbs/ton | Fuel Oil No. 5 lbs/ton | BPL (%) Feed | BPL (%) Tail | BPL (%) Conc. | Recovery % |
|---|---|---|---|---|---|---|---|
| Control | Tall Oil Fatty Acid | 0.5 | 0.5 | 12.3 | 5.14 | 69.15 | 62.83 |
| 31 | 90/10 Tall Oil Fatty Acid Phthalic acid ester[1] | 0.5 | 0.5 | 13.2 | 4.69 | 66.16 | 69.44 |

Note:
[1] =

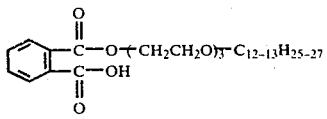

EXAMPLE 32

The procedure of Example 30 was again followed using a reconstituted tall oil fatty acid in combination with a partial ester of cyclohexenyl dicarboxylic acid. The results are as follows:

| Ex. | Collector | Usage lbs/ton | Fuel Oil No. 5 lbs/ton | BPL (%) Feed | BPL (%) Tail | BPL (%) Conc. | BPL Recovery % |
|---|---|---|---|---|---|---|---|
| Control | Tall Oil Fatty Acid | 0.5 | 0.5 | 18.82 | 7.87 | 69.37 | 65.59 |
| 32 | 95/5 Tall Oil Fatty Acid/partial ester[1] | 0.5 | 0.5 | 16.21 | 5.25 | 67.70 | 73.29 |

Note:
[1] =

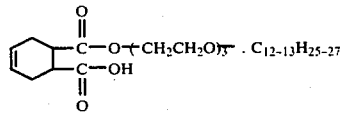

COMPARATIVE EXAMPLE P

The procedure of Example 31 was again followed using reconstituted tall oil fatty acid in combination with a partial ester of a nonethoxylated alcohol and maleic acid. The results are as follows:

| Ex. | Collector | Usage lbs/ton | Fuel Oil No. 5 lbs/ton | BPL (%) Feed | BPL (%) Tail | BPL (%) Conc. | BPL Recovery % |
|---|---|---|---|---|---|---|---|
| Control | Tall Oil Fatty Acid | 1.0 | 1.0 | 16.07 | 8.06 | 62.75 | 57.21 |
| 33A | 90/10 Tall Oil Fatty Acid/partial ester[1] | 0.75 | 0.75 | 18.24 | 7.25 | 63.30 | 68.04 |
| 33B | 90/10 Tall Oil Fatty Acid/par- | | | | | | |

-continued

| Ex. | Collector | Usage lbs/ton | Fuel Oil No. 5 lbs/ton | BPL (%) Feed | Tail | Conc. | BPL Recovery % |
|---|---|---|---|---|---|---|---|
| | tial ester[1] | 1.0 | 1.0 | 11.29 | 5.48 | 62.67 | 72.72 |

Note:
[1] =

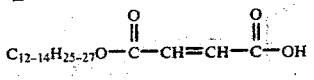

COMPARATIVE EXAMPLE Q

The procedure of Example 31 was again followed using reconstituted tall oil fatty acid in combination with a partial ester of a nonethoxylated alcohol and cyclohexenyl dicarboxylic acid. Results are as follows:

| Ex. | Collector | Usage lbs/ton | Fuel Oil No. 5 lbs/ton | BPL (%) Feed | Tail | Conc. | BPL Recovery % |
|---|---|---|---|---|---|---|---|
| Control | Tall Oil Fatty Acid | 0.5 | 0.5 | 18.82 | 7.87 | 69.37 | 65.59 |
| 34 | 95/5 Tall Oil Fatty Acid/partial Ester[1] | 0.5 | 0.5 | 17.00 | 5.98 | 67.51 | 71.98 |

Note:

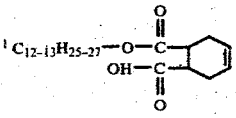

COMPARATIVE EXAMPLE R

The procedure of Example 30 is again repeated using reconstituted tall oil fatty acid in combination with a partial ester of a non-ethoxylated alcohol and phthalic acid. Results are as follows:

| Ex. | Collector | Usage lbs/ton | Fuel Oil No. 5 lbs/ton | BPL (%) Feed | Tail | Conc. | BPL Recovery % |
|---|---|---|---|---|---|---|---|
| Control | Tall Oil Fatty Acid | 0.5 | 0.5 | 12.30 | 5.14 | 69.15 | 62.83 |
| 35 | 90/10 Tall Oil Fatty Acid/partial ester[1] | 0.5 | 0.5 | 12.89 | 5.02 | 68.61 | 65.87 |

Note:
[1] =

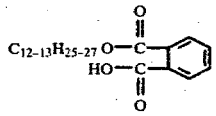

EXAMPLE 33

When the procedure of Example 8 is followed in every material detail except that the partial ester employed is of the general structure:

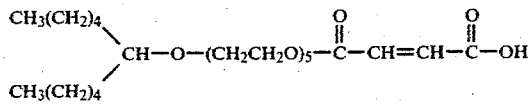

substantially equivalent results are obtained.

EXAMPLE 34

When the procedure of Example 8 is followed in every material detail except that the partial ester employed is of the general structure:

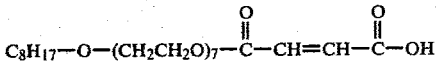

substantially equivalent results are obtained.

EXAMPLE 35

When the procedure of Example 8 is followed in every material detail except that the partial ester employed is of the general structure:

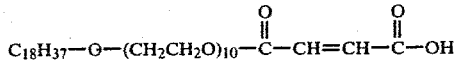

substantially equivalent results are obtained.

We claim:

1. A process for the beneficiation of non-sulfide, iron-free ores which comprises classifying the ore to provide particles of flotation size, slurrying the sized ore in aqueous medium, conditioning the slurry with an effective amount of a combination of about 99 to about 5 weight percent of a fatty acid derived from a vegetable or animal oil and, correspondingly, from about 1 to about 95 weight percent of a partial ester of a polycarboxylic acid having at least one free carboxylic acid group, and floating the desired ore by froth flotation, said partial ester having the structure:

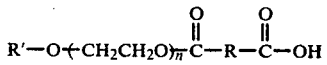

wherein R′ is a primary or secondary alkyl group of about 8 to 18 carbon atoms, n is an integer of about 1–10 and R is a bivalent grouping selected from $-(CH_2)_m-$ wherein m is an integer of 1 to 6, —CH=CH—, —CHOH—CHOH—,

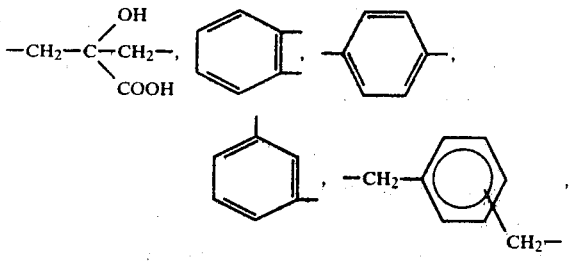

ortho, meta, and para, $—C_6H_8—$, and $—C_6H_{10}$.

2. The process of claim 1 wherein said partial ester has a structure wherein R is —CH=CH—.

3. The process of claim 1 wherein said partial ester has a structure wherein R′ is an alkyl group of 11 to 15 carbon atoms.

4. The process of claim 1 wherein n=3.

5. The process of claim 1 wherein said non-sulfide ore is fluorite.

6. The process of claim 1 wherein said non-sulfide ore is barite.

7. The process of claim 1 wherein said non-sulfide ore is cement rock.

8. The process of claim 1 wherein said non-sulfide ore is phosphate rock.

* * * * *